US009309081B2

(12) United States Patent
Duehring et al.

(10) Patent No.: US 9,309,081 B2
(45) Date of Patent: Apr. 12, 2016

(54) ACTIVE CENTER PIVOT DEVICE FOR CONTROLLING SHEET TENSION AND METHOD OF USING SAME

(71) Applicant: Kimberly-Clark Worldwide, Inc., Neenah, WI (US)

(72) Inventors: Douglas N. Duehring, Appleton, WI (US); Mark G. Dollevoet, Appleton, WI (US); Jason M. Rudolph, Kimberly, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 213 days.

(21) Appl. No.: 14/054,216

(22) Filed: Oct. 15, 2013

(65) Prior Publication Data

US 2015/0102152 A1 Apr. 16, 2015

(51) Int. Cl.

| | |
|---|---|
| ***B65H 23/18*** | (2006.01) |
| ***B65H 23/04*** | (2006.01) |
| *B65H 23/188* | (2006.01) |

(52) U.S. Cl.

CPC ..... *B65H 23/048* (2013.01); *B65H 23/188* (2013.01); *B65H 2402/31* (2013.01); *B65H 2515/32* (2013.01)

(58) Field of Classification Search

USPC ..... 242/413, 413.3, 417, 419, 419.1, 419.8, 242/420.2

See application file for complete search history.

(56) References Cited

U.S. PATENT DOCUMENTS

| | | | | |
|---|---|---|---|---|
| 3,279,719 | A | 10/1966 | Kabelitz et al. | |
| 3,390,843 | A | 7/1968 | Young | |
| 3,453,847 | A | 7/1969 | Romanauskas | |
| 3,720,383 | A | 3/1973 | Crawford | |
| 3,912,145 | A | 10/1975 | Meihofer | |
| 4,100,012 | A | 7/1978 | Meihofer et al. | |
| 4,146,190 | A | 3/1979 | Bond | |
| 4,151,594 | A | 4/1979 | Stern | |
| 4,159,808 | A | 7/1979 | Meihofer | |
| 4,291,441 | A * | 9/1981 | Bassani | 26/75 |
| 4,645,109 | A | 2/1987 | Fleissner | |
| 4,802,949 | A | 2/1989 | Mitsam | |

(Continued)

FOREIGN PATENT DOCUMENTS

| | | |
|---|---|---|
| DE | 202011051866 | 1/2012 |
| GB | 1076480 | 7/1967 |

(Continued)

OTHER PUBLICATIONS

International Search Report and Written Opinion for PCT/IB2014/064232 dated Dec. 17, 2014.

(Continued)

*Primary Examiner* — Sang Kim

(74) *Attorney, Agent, or Firm* — Dority & Manning, P.A.

(57) ABSTRACT

A device for controlling web tension is disclosed. The device includes a carriage in which a first guide roller is spaced from a second guide roller by a frame. The carriage or frame pivots about a pivot location. A moving web is threaded through the carriage in a serpentine path. Rotation of the carriage or frame causes web displacement. When tension disturbances occur in the moving web, the device rotates for accumulating or releasing the web material and thereby dampening tension variations downstream. The pivot dancer device can be placed in a communication with a controller for open loop control or closed loop feedback control.

9 Claims, 10 Drawing Sheets

(56) References Cited

U.S. PATENT DOCUMENTS

| | | | |
|---|---|---|---|
| 5,357,178 | A | 10/1994 | Kapitan |
| 5,602,747 | A | 2/1997 | Rajala |
| 5,659,229 | A | 8/1997 | Rajala |
| 5,671,895 | A | 9/1997 | Cederholm et al. |
| 5,709,331 | A | 1/1998 | Lam et al. |
| 5,779,830 | A | 7/1998 | Wakefield et al. |
| 5,830,117 | A | 11/1998 | Anderson |
| 6,024,319 | A | 2/2000 | Kawabata et al. |
| 6,473,669 | B2 | 10/2002 | Rajala et al. |
| 6,856,850 | B2 | 2/2005 | Rajala et al. |
| 7,438,251 | B2 | 10/2008 | St. Germain et al. |
| 2012/0280076 | A1 | 11/2012 | Schultze et al. |

FOREIGN PATENT DOCUMENTS

| | | |
|---|---|---|
| JP | 54013174 | 1/1979 |
| JP | 08206764 | 8/1996 |
| JP | 0952662 | 2/1997 |
| JP | 11106109 | 4/1999 |
| KR | 10-2011-0102025 | 9/2011 |
| WO | WO 95/18762 | 7/1995 |

OTHER PUBLICATIONS

Pagilla et al., Periodic Tension Disturbance Attenuation in Web Process Lines Using Active Dancers, Journal of Dynamic Systems, Measurement Control, dated Sep. 2003, vol. 125, pp. 361-371.

* cited by examiner

ACTIVE CENTER PIVOT DEVICE FOR CONTROLLING SHEET TENSION AND METHOD OF USING SAME

BACKGROUND

Winders and rewinders are machines that roll lengths of paper, such as tissue paper, into rolls. A winder is typically known as an apparatus that performs the very first wind of the paper web, forming what is generally known as a parent roll. A rewinder, on the other hand, is typically known as an apparatus that unwinds the parent roll into smaller rolls that represent the finished product. For instance, in one embodiment, a parent roll of bath tissue can be unwound in a continuous fashion by a rewinder and fed into a process by which the paper web is wound onto cores supported on mandrels to provide individual, relatively small diameter logs. The rolled product log can then be cut to designated lengths into the final product. In addition to toilet tissue rolls, other final products that can be made by this process include paper towels, paper rolls, and the like.

To conserve bulk in the finished product, especially when producing toilet tissue rolls and paper towel rolls, the parent rolls may be wound somewhat loose. Typically, the parent rolls are moved to storage locations until they are consumed in a converting process during which the final products are made. The handling and storage of the parent rolls can subject the rolls to certain stresses that cause the rolls to become disoriented from a pure cylindrical shape. Storing a parent roll on a hard surface, for instance, can cause a flat spot on the roll. Such rolls can have an elliptical or eccentric shape depending upon how the roll is handled.

As the rolls are unwound by a rewinder, any out-of-roundness characteristics may cause tension disturbances within the sheet material. These tension disturbances can cause many problems. Differences in tension in the web as the web is fed into a process can cause machine malfunctions, web breaks, and can lead to the production of non-uniform final products.

In the past, in order to control tension fluctuations, dancer rolls were inserted into the process between first and second sets of driving rolls or between first and second nips. The basic purpose of a dancer roll is to maintain constant tension on the continuous web as the web is fed into a downstream process and traverses a span between first and second sets of driving rolls.

As the web traverses the span, passing over the dancer roll, the dancer roll moves up and down in a track, serving two functions related to stabilizing the tension in the web. First, the dancer roll provides a damping effect on intermediate term disturbances in the tension in the web. Second, the dancer roll temporarily absorbs the difference in drive speeds between the first and second sets of driving rolls, until such time as the drive speeds can be appropriately coordinated.

Typically, the dancer roll is suspended on a support system, wherein a generally static force supplied by the support system supports the dancer roll against an opposing force applied by the tension in the web and the weight of the dancer roll. So long as the tension in the web is constant, the dancer roll remains generally centered in its operating window on the track.

When the web encounters an intermediate or long term tension disturbance, temporarily increasing or decreasing the tension in the web, the imbalances of forces on the dancer roll cause translational movement in the dancer roll to temporarily restore the tension, and thereby the force balance. So when difference in the speeds of the first and second sets of drive rolls tend to accord a change in the web tension, the dancer roll temporarily maintains the tension.

Thus, the dancer roll generally stabilizes the tension in the web, by compensating for temporary changes in the operating tension. While the dancer roll, as conventionally used, provides valuable functions, it also has its limitations.

Examples of dancer rolls are described in U.S. Pat. No. 5,659,229 and in U.S. Pat. No. 6,856,850, which are both incorporated herein by reference. The dancer roll disclosed in the '229 patent is an active roll in which active and variable forces are applied to the dancer roll. The system and method disclosed in U.S. Pat. No. 5,659,229 have provided great advances in the art.

Further improvements are still needed, however, in the ability to control web tension. For instance, a need still remains for a device for controlling web tension that has fast response times, especially when the paper web is moving at high speeds.

SUMMARY

The present disclosure is generally directed to an apparatus, systems and methods for controlling tension and tension disturbances in a continuous web during processing of the web. In accordance with the present disclosure, a pivot dancer device is used for applying active and variable forces to a moving web in response to irregularities, such as variations in tension. In one aspect, the system and method of the present disclosure can be used to attenuate undesired disturbances in the web as the web is being fed into a process.

In one embodiment, the present disclosure is directed to a device for controlling tension in a sheet being fed to a process. The device includes a first guide roll spaced from a second guide roll. The first and second guide rolls may be stationary with a frictionless surface or may comprise rotating guide rolls. The first and second guide rolls are held in a coplanar relationship by a first frame. The first frame is pivotally attached to a second frame at a pivot location between the first and second guide rolls. In one embodiment, the pivot location may be located at about the midpoint between the first and second guide rolls.

In accordance with the present disclosure, the device further includes a torque supplying device that supplies a controllable amount of torque to the first frame at the pivot location. The torque supplying device, for instance, may comprise a motor that is coupled to the first frame by a belt.

In one embodiment, the present disclosure is directed to a system for controlling web tension that includes a first load cell that measures sheet tension prior to or upstream from the first guide roll and a second load cell that measures sheet tension after or downstream from the second guide roll. A torque controller may be included that receives sheet tension information from the first load cell and the second load cell. Based on a comparison of sheet tension before the first guide roll to sheet tension after the second guide roll, the torque controller can be configured to respond to web disturbances and adjust the amount of torque applied to the first frame for maintaining constant tension on the web.

In one embodiment, the moving web travels through the device in a serpentine path. For instance, the web may be guided below the first guide roller and over the second guide roller or vice versa. Consequently, rotation of the first frame causes web displacement and can be used to dampen tension variations. In one embodiment, the device for controlling tension can be configured such that the first frame can pivot about the pivot location in an amount of at least about 90° to less than about 360°, such as from about 90° to about 240°, such as from about 120° to about 180°.

The present disclosure is also directed to a method for controlling tension in a sheet being fed to a process. The method includes unwinding a roll of material from an unwind device. The material is fed over a pivot dancer device in accordance with the present disclosure. The pivot dancer device includes a torque supplying device that can apply a controlled amount of torque to the pivot dancer device for adjusting tension in the material. The pivot dancer device is configured to pivot at least 90° but less than 360°.

In accordance with the present disclosure, the tension of the material is controlled by adjusting the speed by which the roll of material is unwound, by adjusting the amount of torque applied to the pivot dancer device, or by a combination of both.

In one embodiment, the pivot dancer device comprises the device for controlling tension described above and can include a first guide roller spaced from a second guide roller and held in a coplanar relationship.

In one embodiment, the method further includes the steps of measuring the rotational velocity of the pivot dancer device, measuring the tension in the material before the pivot dancer device, and measuring the tension in the material after the pivot dancer device. Based on the material tension before the pivot dancer device in comparison to the material tension after the pivot dancer device, the amount of torque applied to the pivot dancer device is adjusted using the torque supplying device.

A controller can be used to control the amount of torque applied to the pivot dancer device. The controller can also be configured to receive information regarding tension and velocity as described above. In one embodiment, the controller determines tension based upon a closed loop algorithm.

In one embodiment, an amount of torque to apply to the pivot dancer device can be computed by using the following equation:

$$\alpha \cdot J = T_{app} - \omega \cdot \beta_w - K_t \cdot \Delta\Theta \cdot R_{eff} - \cos(\Phi) \cdot R_{eff} \cdot F_b - \cos(\Phi) \cdot R_{eff} \cdot F_c$$

Where $\alpha$ is the angular acceleration of pivot dancer device

J is the inertia of pivot dancer device $T_{app}$ is the applied torque to the pivot dancer device $\omega$ is the angular velocity of the pivot dancer device $\beta_w$ is the angular damping friction $K_t$ the tension spring constant $\Delta\Theta$ is the change in angular position $R_{eff}$ is the effective moment radius $\Phi$ is the angle between incoming/outgoing material path angle and material path normal $F_b$ is the incoming material tension; and $F_c$ is the outgoing material tension.

In another embodiment of the present disclosure, the method includes the steps of monitoring the position of the pivot dancer device and, based on the monitored position, adjusting the speed at which the web is unwound in order to maintain the pivot dancer device within a certain location.

In still another embodiment, the method includes monitoring the angular velocity of the pivot dancer device while the web of material is being unwound. Based on the angular velocity, the torque applied to the pivot dancer device can be adjusted in reaction to disturbances in the web for dampening tension variations. In this embodiment, a controller can be used to control the amount of torque applied to the pivot dancer device. The controller may determine the torque using an open loop algorithm.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
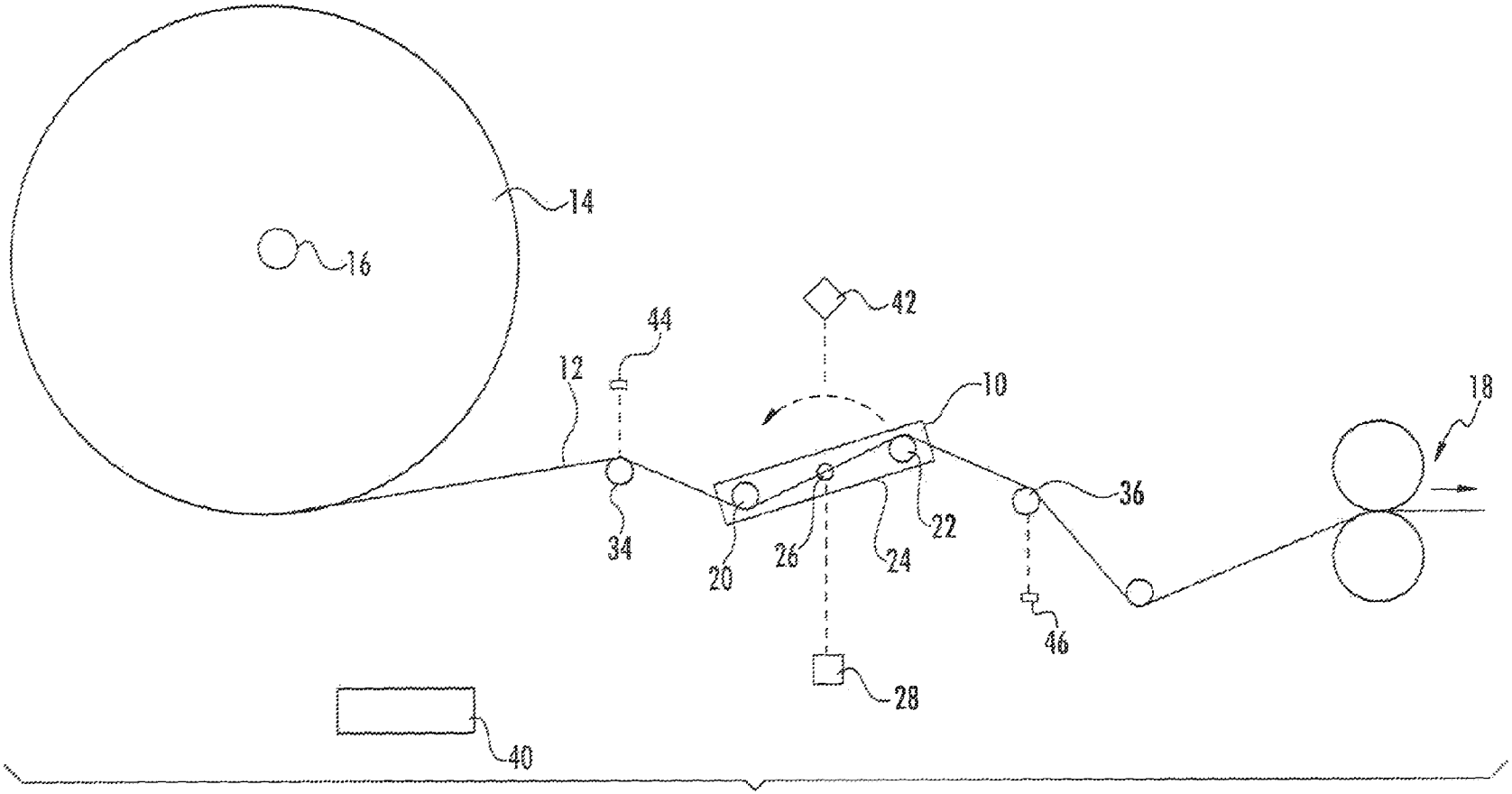
FIG. 1 is a side view of one embodiment of a system made in accordance with the present disclosure for controlling tension in a web of material.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to an apparatus for controlling web tension. The present disclosure is also directed to methods and systems for controlling web tension. The apparatus of the present disclosure is particularly well suited for use in systems where a roll of material is being unwound and fed into a processing line. The processing line may be manipulating the material and incorporating it into a product. Alternatively, the processing line may comprise a converting process for converting a large roll of material into a plurality of smaller sized product rolls.

When a sheet of material is being fed into a process, in some applications, it may be important to control the tension of the material. In the past, various dancer rolls were used to control tension. The primary purpose of a dancer roll is to maintain constant tension on the web. With the need for increased performance and productivity, effective web handling and control systems are needed for increasing the web processing speed and the quality of the final products. Consequently, a need exists for improved methods for maintaining web tension within desired limits under a wide range of dynamic conditions. Disturbances in web tension, for instance, can be caused by line speed changes, parent roll diameter variations, parent roll out-of-roundness, and variances within the web properties. Tension variations within the web can adversely affect line runnability and performance resulting in increased web breaks, wrinkles, and the ability to produce uniform products.

The present disclosure is directed to a device for controlling web tension that is highly responsive to tension variations. Conventional active and passive dancer rolls, for instance, are limited in their ability to control downstream tension while in motion. These assemblies experience forces due to gravity and static friction that limit their ability to attenuate tension disturbances. As will be described in greater detail below, the device for controlling tension in accordance with the present disclosure experiences no forces due to gravity and experiences only limited bearing friction when in use. Of particular advantage, the device of the present disclosure is a fairly simple design with few moving parts, which is in contrast to conventional linear dancer rolls that have a complex set of cable and pulley assemblies.

By using a dancer assembly having faster response times to tension fluctuations, the apparatus and method of the present disclosure can provide various advantages and benefits. For instance, by incorporating the pivot dancer device of the present disclosure into a processing line, the processing line can process parent rolls having greater irregularities. For instance, the pivot dancer device of the present disclosure allows for out-of-round parent rolls to be processed while still maintaining constant tension downstream.

In the past, manufacturers of sheet materials have carefully controlled the manner in which the sheet materials were produced and have carefully controlled the conditions under which the parent rolls were stored in order to avoid the necessity of having to process out-of-round rolls. For example, manufacturers of paper webs typically use great amounts of energy to make sure that the web is completely dried before the web is wound onto a parent roll. A dryer web will generally produce less out-of-roundness rolls and provides for a better material for use in converting processes. Consequently, paper webs, and particularly tissue webs such as bath tissue and paper towels, are typically dried so that the moisture content in the web is no greater than about 2% by weight. Requiring the webs to be dried to such extreme amounts, however, slows processing speeds significantly and can greatly increase the cost of producing the product.

In addition to thoroughly drying the webs, manufacturers of paper webs also carefully handle and store the parent rolls prior to being used in a converting process in order to prevent out-of-roundness. For instance, storing the parent rolls on a flat surface or stacking the rolls can create flat surfaces which can create problems when the rolls are unwound into a process.

Because the pivot dancer device of the present disclosure has extremely fast response times to tension variations, processes incorporating the device are capable of processing paper rolls that have a greater amount of out-of-roundness. According to the present disclosure, out-of-roundness rolls can be processed at the same speeds as used in the past. Having the capability to process out-of-roundness rolls allows manufacturers to produce sheet materials that contain a greater amount of moisture and allows manufacturers to store the rolls more efficiently. For example, use of the pivot dancer device of the present disclosure allows manufacturers to produce parent rolls with greater amounts of moisture. Allowing the paper machines to produce a wetter roll allows for higher processing speeds and greater throughput to make the web. An additional benefit is that the parent rolls produced may potentially be double stacked in a warehouse prior to converting. By increasing warehouse capacity, less paper machine grade changes may be needed.

Figure 2:
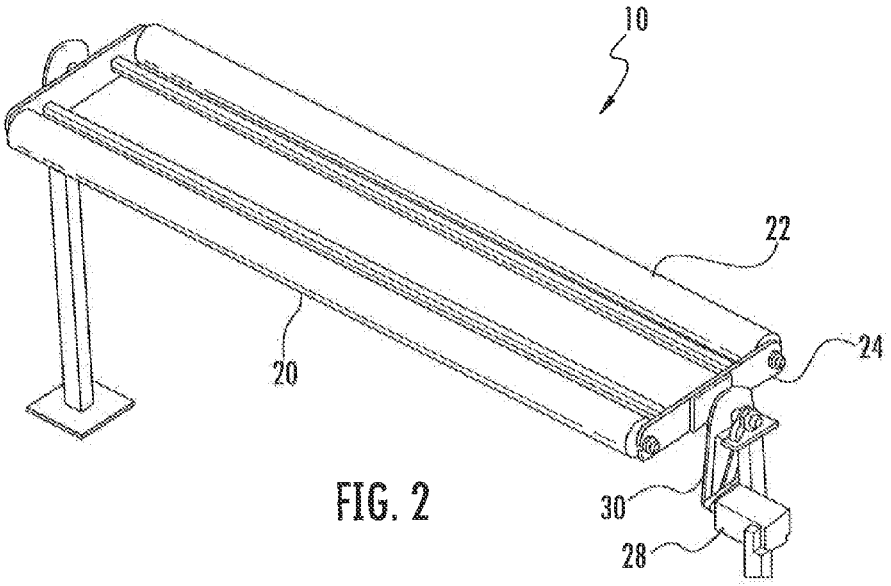
FIG. 2 is a perspective view of one embodiment of a pivot dancer device made in accordance with the present disclosure.
Figure 3:
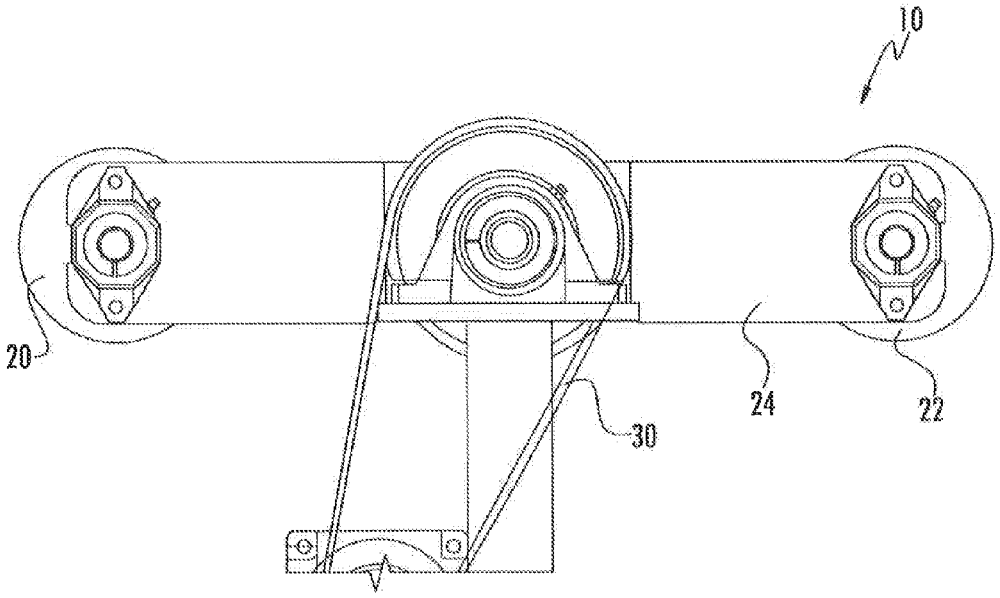
FIG. 3 is a side view of the pivot dancer device illustrated in FIG. 2.

Referring to FIGS. 1-3, one embodiment of a pivot dancer device 10 made in accordance with the present disclosure is shown. In FIG. 1, the pivot dancer device 10 is shown as part of a process by which a sheet of material 12 is unwound from a parent roll 14 and fed downstream. The pivot dancer device 10 is configured to respond to tension variations in the sheet of material 12 so that the material 12 is fed downstream at a relatively constant tension.

As shown in FIG. 1, the parent roll 14 is unwound using an unwind device 16, such as a motor. Speed of advance of the web material is controlled by the unwind motor 16 in combination with, in this embodiment, the speed of a nip 18 positioned downstream from the pivot dancer device 10.

The pivot dancer device 10 includes a first guide roll 20 spaced from a second guide roll 22. The first guide roll 20 and the second guide roll 22 may comprise rotatable rolls or may comprise stationary rolls that have a frictionless surface. The first guide roll 20 is generally in a coplanar relationship with the second guide roll 22. The first guide roll 20 and the second guide roll 22 are maintained in position by a first frame 24. The first frame 24 includes a pivot location 26. The first frame 24 is configured to pivot about the pivot location 26, causing the guide rolls 20 and 22 to rotate about the pivot location. In one embodiment, the pivot location is positioned midpoint between the first guide roll 20 and the second guide roll 22.

The pivot dancer device 10 may also be placed in association with a first fixed roll 34 and a second fixed roll 36. The fixed rolls 34 and 36 may facilitate web displacement when the pivot dancer device 10 rotates. As will be described in greater detail below, the fixed rolls 34 and 36 may also be used to facilitate measurements of tension in the web 12.

As shown more particularly in FIGS. 2 and 3, the first frame 24 is coupled to a torque supplying device 28. The torque supplying device 28 can comprise a motor. The motor can be coupled to the frame 24 by a belt 30 through a system of one or more pulleys. The two guide rollers 20 and 22 each support the web 12 through the pivot dancer device. The torque supplying device 28 is configured to move the first frame 24 to a desired and controlled location.

As shown in FIG. 1, the web of material 12 assumes a serpentine travel path through the pivot dancer device 10. In particular, the web of material 12 is located under the first guide roller 20 and over the second guide roller 22. This arrangement may be reversed such that the web travels over the first guide roller 20 and under the second guide roller 22.

During operation, the torque supplying device 28 delivers a torque to the first frame 24 at the pivot location 26. In this manner, the guide rollers 20 and 22 apply a force to the sheet of material as the material is passing through the pivot dancer device 10. Any tension disturbances in the web cause the first frame 24 to rotate which, in turn, causes web displacement. In particular, if an increase in web tension upstream of the pivot dancer device is experienced, the first frame rotates away from the web of material. Decreases in tension, on the other hand, cause the first frame to rotate towards the web of material. The rotation of the first frame and the guide rollers causes the material to either be accumulated within the pivot dancer device or to be released by the pivot dancer device. In this manner, the pivot dancer device 10 can react to tension disturbances upstream and maintain constant tension downstream.

Once a tension disturbance is experienced causing the first frame to rotate, the torque delivered to the first frame by the torque supplying device and/or the speed at which the material is unwound from the parent roll by the unwind device can be varied or controlled such that the first frame rotates back to an initial position or to any desired position.

For instance, in one embodiment, the position of the first frame 26 may be constantly monitored by a position sensing device, such as a transducer. When the first frame 26 rotates in response to tension variations, the transducer can send signals to a controller such as the computer 32 shown in FIG. 1. The computer can be in communication with the torque supplying device 28 and/or the unwind device 16. Based on information received from the transducer, the controller 32 can then send a corrective signal to the unwind device 16 and/or the torque supplying device 28. In this manner, the speed of the web of material exiting the parent roll can be increased or decreased and/or the amount of torque applied to the pivot location 26 can also be increased or decreased such that the first frame 26 can be returned to a desired location, such as the midpoint of its operating position. In one embodiment, the torque supplying device may apply a constant torque and the unwind device 16 may be used solely to adjust the position of the first frame 24. Alternatively, the torque supplying device 28 may be used solely to adjust the position of the first frame 24.

Figure 4A:
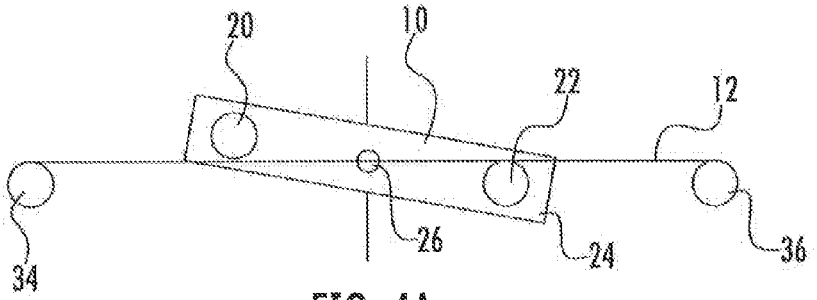
FIGS. 4A-4G are side views of a pivot dancer device in accordance with the present disclosure showing different rotational positions of the device.
Figure 4B:
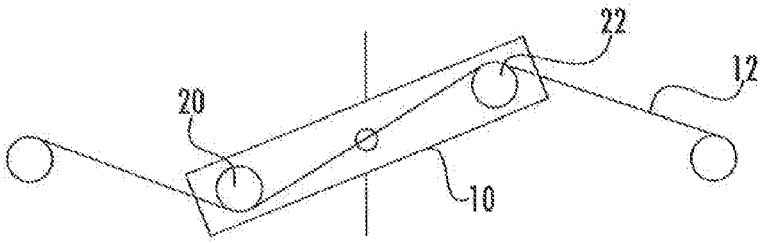
Figure 4C:
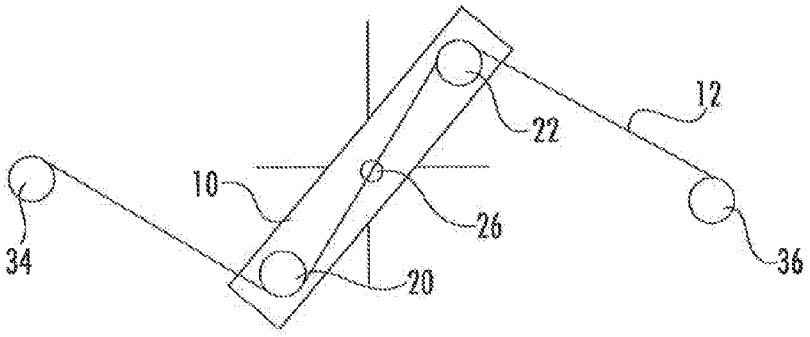
Figure 4D:
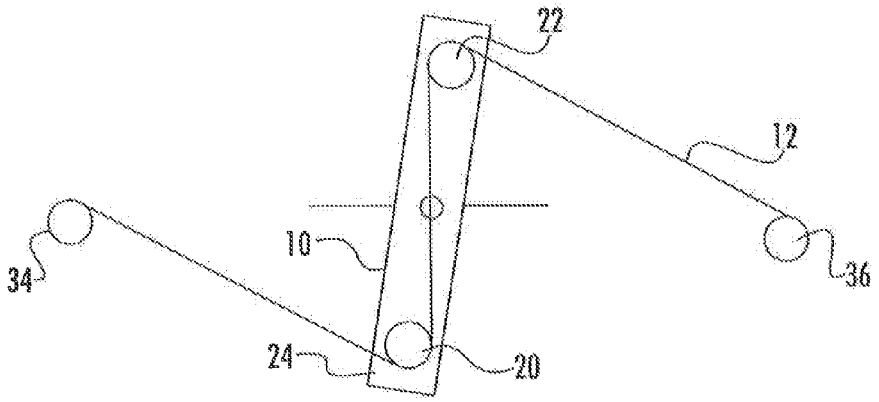
Figure 4E:
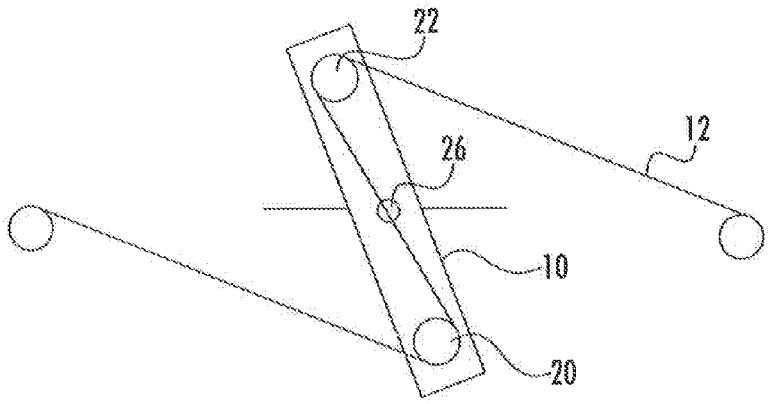
Figure 4F:
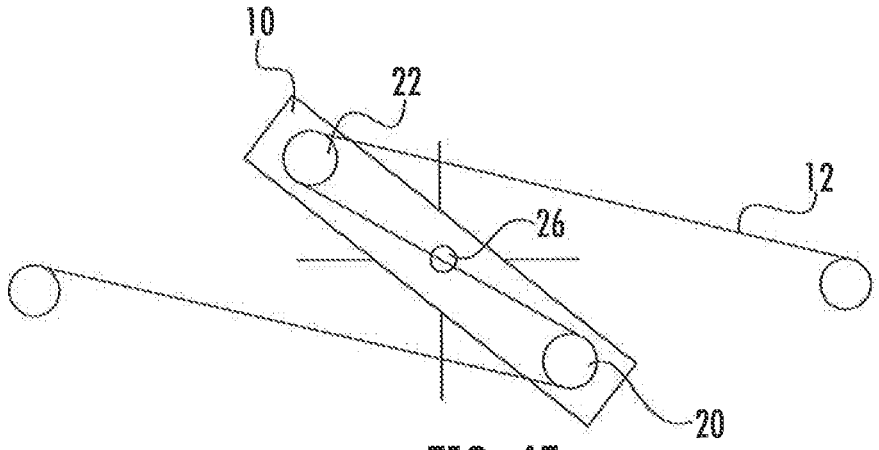
Figure 4G:
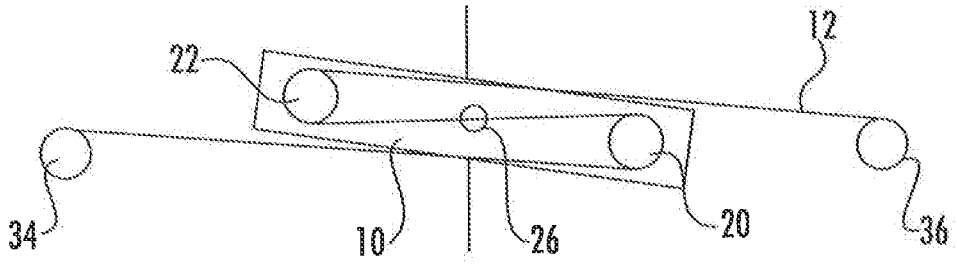

As described above, as the pivot dancer device 10 rotates, the moving web 12 is displaced which allows for the dampening of tension variations downstream. Referring to FIGS. 4A-4G, web displacement on the pivot dancer device 10 is illustrated as the pivot dancer device rotates. In FIG. 4A, for instance, the web 12 is essentially at 0 degrees as the web traverses through the pivot dancer device 10. In FIG. 4B, the pivot dancer device 10 has rotated and now the web forms a 30° angle with the horizontal. In FIG. 4C, the pivot dancer device 10 has rotated more about the pivot location 26 such that the web 12 forms a 60° angle with the horizontal. In FIG. 4D, the web 12 is at a 90° angle, while in FIG. 4E, the web is at a 120° angle with the horizontal. In FIG. 4F, the web 12 forms a 150° angle with the horizontal and in FIG. 4G, the web is at a 180° angle. As shown, the pivot dancer device 10 is configured to rotate from 0° to less than 360°, such as less than about 220°. For many embodiments, the pivot dancer device is configured to rotate from 0° to about 200°, such as about 180° as particularly shown in FIG. 4G.

The amount that the web 12 displaces as the pivot dancer device 10 rotates depends on various dimensions. Web displacement can be calculated as a function of the angular position of the web between the guide roll 20 and the guide roll 22 and a straight line between the fixed rollers which is referred to herein as the web angle. The web angle in FIGS. 4A-4G is relative to the horizontal axis.

Figure 5:
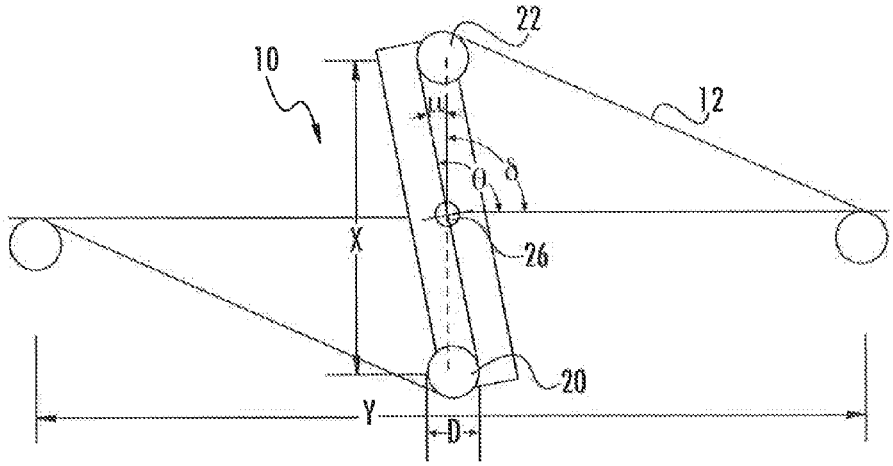
FIG. 5 is a side view of a pivot dancer device in accordance with the present disclosure including variables for calculating web displacement.

Referring to FIG. 5, various dimensions and angles have been labeled in order to calculate web displacement through the pivot dancer device 10. The web displacement can be defined as the difference in the web path from the straight line (FIG. 4A) between the first guide roll 20 and the second guide roll 22. Web displacement can be calculated as follows:

$$L=\sqrt{X^2-D^2}+D[\pi+\arcsin(D/X)+\arcsin(D/\sqrt{X^2+Y^2XY\cos\delta}-\arccos((X-Y\cos\delta)/\sqrt{X^2+Y^2-2XY\cos\delta})]+2\sqrt{X^2+Y^2-2XY\cos\delta-D^2}-Y$$

Where

L=Web displacement

D—Active Dancer Idler diameter

X—Active Dancer Distance between idler centers

Y—Distance between fixed rollers

θ—Web angle—the angle between the web path through the carriage and the straight line between the fixed rollers δ—Angle between the centerline of the carriage idlers and the straight line between the fixed rollers $\delta=\theta-\arcsin(D/X)$ The web displacement calculation above is for one embodiment of the present disclosure. The above equation assumes that the pivot location 26 is on the center of a straight line between the first guide roll 20 and the second guide roll 22. In an alternative embodiment, however, the pivot location may be moved off the above straight line which would change the above equation.

In one embodiment, the distance between the first guide roll 20 and the second guide roll 22 can be from about 1 ft. to about 4 ft. The diameter of the guide rolls can be about 4 in. to about 8 in. The distance between the fixed rollers can be from about 4 ft. to about 20 ft.

Figure 6:
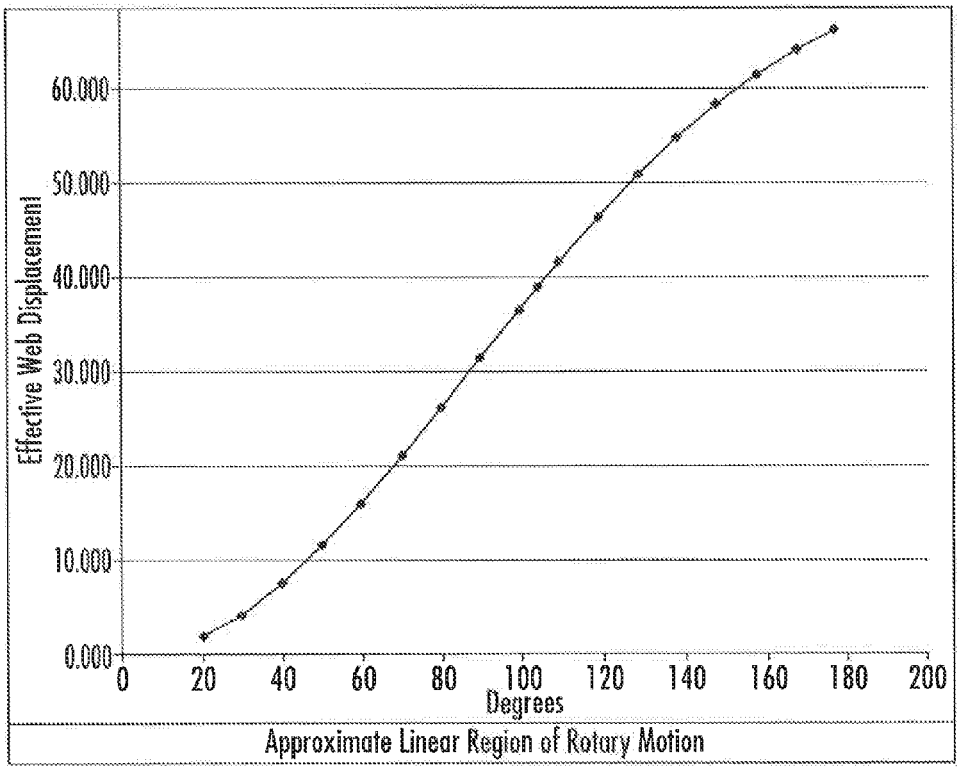
FIG. 6 is a graph illustrating web displacement versus rotation for a pivot dancer device made in accordance with the present disclosure.

FIG. 6 shows the approximate linear region of rotary motion of the pivot dancer device 10 based on web displacement for the particular embodiment illustrated in FIG. 5.

Figure 7:
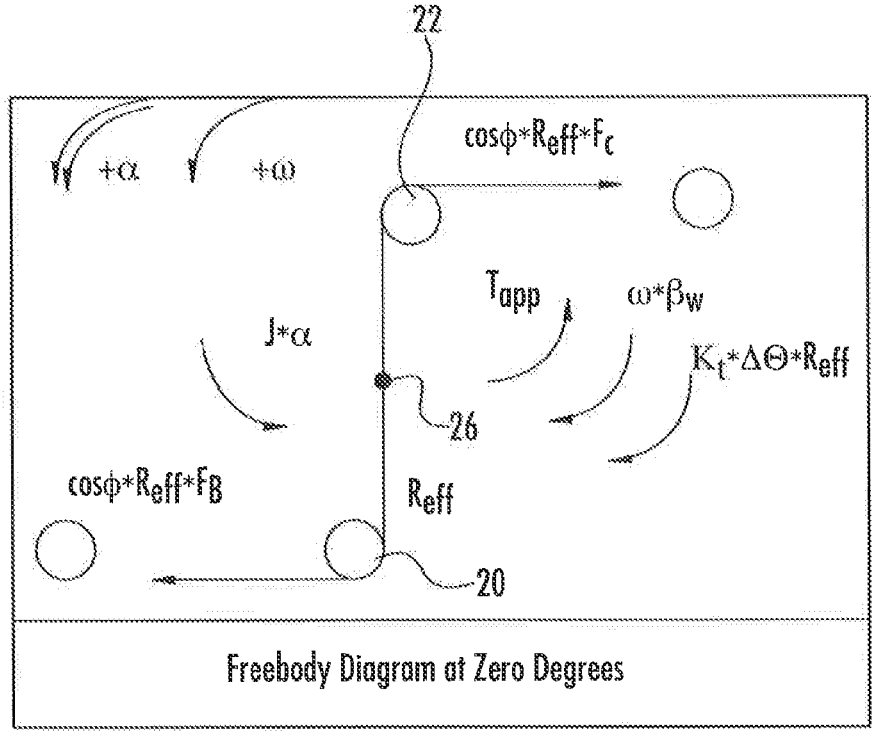
FIG. 7 is a free body diagram of a pivot dancer device made in accordance with the present disclosure at 0 degrees.
Figure 8:
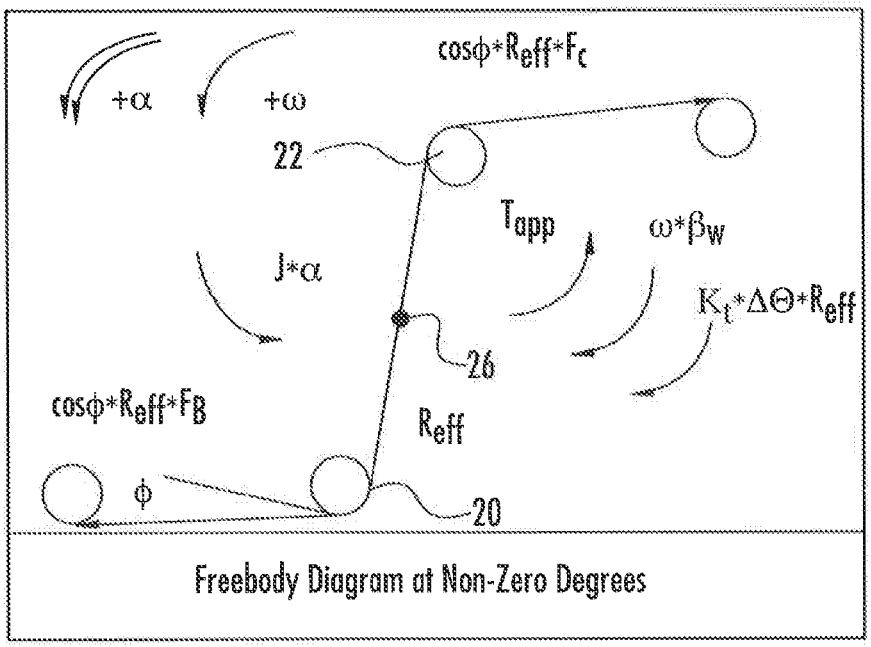
FIG. 8 is a free body diagram of a pivot dancer device made in accordance with the present disclosure at non-0 degrees.

The pivot dancer device 10 can be incorporated into a moving web or sheet processing system and controlled and manipulated in various ways depending upon the particular application. Referring to FIG. 1, in one embodiment, a controller 40, such as a programmable device (i.e. a computer) can be configured to receive various information and to calculate an output that controls the web-let off speed, the amount of torque applied to the pivot location of the pivot dancer device 10, etc. In one embodiment, the controller 40 may be programmed with various algorithms for controlling the different system parameters. In one embodiment, for instance, the following free body equations can be programmed into the controller 40. The variables for the free body equations are illustrated in FIGS. 7 and 8. The following equation can be derived:

$$\alpha\cdot J=T_{app}-\omega\cdot\beta_w-K_t\cdot\Delta\Theta\cdot R_{eff}-\cos(\Phi)\cdot R_{eff}\cdot F_b-\cos(\Phi)\cdot R_{eff}\cdot F_c$$

Where

α is the angular acceleration of pivot dancer device

J is the inertia of pivot dancer device $T_{app}$ is the applied torque to the pivot dancer device ω is the angular velocity of the pivot dancer device $\beta_w$ is the angular damping friction $K_t$ is the tension spring constant ΔΘ is the change in angular position $R_{eff}$ is the effective moment radius Φ is the angle between incoming/outgoing material path angle and material path normal $F_b$ is the incoming material tension; and $F_c$ is the outgoing material tension.

With respect to the equation above, the angular acceleration multiplied by the rotary dancer inertia is equaled to the sum of the moments applied to the pivot dancer device ($\Sigma M_O$).

In one embodiment, the above equations can be used in a closed loop control system using the controller 40 as shown in FIG. 1. In this embodiment, active dampening and stiffness of tension can be used as illustrated in FIG. 9.

In one embodiment, for the closed loop control system, the system can include an angular velocity or position sensor 42 that senses the angular velocity of the pivot dancer device 10. The system can also include a first load cell 44 that measure tension in the web 12 upstream from the pivot dancer device 10 and a second load cell 46 that measures tension in the web 12 downstream from the pivot dancer device 10. The angular velocity sensor 42, the first load cell 44, and the second load cell 46 can all be configured to send information (i.e. the sensed variable) to the controller 40 as shown in FIG. 9.

Figure 9:
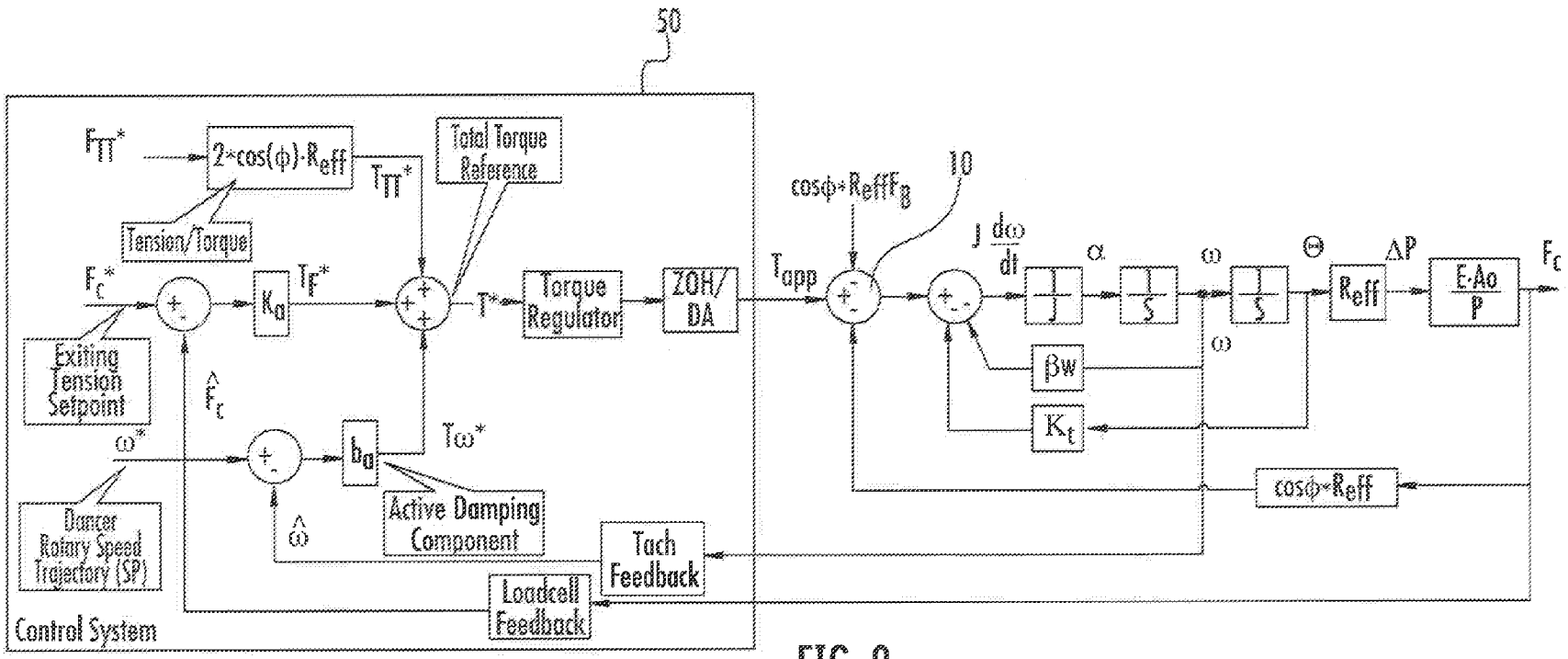
FIG. 9 is one embodiment of a control system block diagram.

Referring to FIG. 9, the box 50 represents the calculations that occur inside the controller 40 as shown in FIG. 1. The controller 50 calculates a resultant output, $T_{app}$, which is the amount of torque applied to the pivot dancer device 10 by the torque supplying device 28. The circle to the right of the box 50 represents the pivot dancer device 10. Also shown are the forces which act on the pivot dancer device.

In this embodiment, the rotational velocity of the pivot dancer device 10 is monitored and continuously fed to the controller 40 along with sheet tension prior to and after the pivot dancer device. During operation, the controller 40 compares the web tension before the pivot dancer device and after the pivot dancer device to determine a web tension value. If the web tension value is out of a specified limit, the controller 40 can then calculate the amount of torque to apply to the pivot dancer device 10. This signal is fed to the torque supplying device 28 which adjusts the amount of torque applied to the pivot dancer device 10 which, in some embodiments, may cause the pivot dancer device 10 to rotate in order to dampen tension fluctuations. As described above, this can be a closed loop system such that these calculations can occur continuously as the web is processed.

The pivot dancer device 10 of the present disclosure can provide numerous benefits and advantages in relation to conventional linear dancer devices that move up and down. For instance, as shown by the equations above, the product of the mass of a dancer roll and gravity is no longer a force that needs to be accounted for in adjusting web tension. Consequently, the pivot dancer device is extremely responsive to web tension variations and has a very fast reaction time.

Through the use of the pivot dancer device 10, the operating window of the dancer assembly is improved. Ultimately, the processing system has the ability to process more significantly out-of-round rolls while still feeding the unwound web into the processing line under constant tension. As explained above, because less round rolls can be processed, a manufacturer may not have to dry a web to the same extent as was required in the past. For instance, a paper web, particularly a tissue web, may be dried to greater than 2% moisture by weight, such as from about 2% to about 4% moisture by weight. Further, the pivot dancer device of the present disclosure may allow for stacking of the parent rolls leading to increased warehouse space and the ability to stockpile greater amounts of material.

Figure 10:
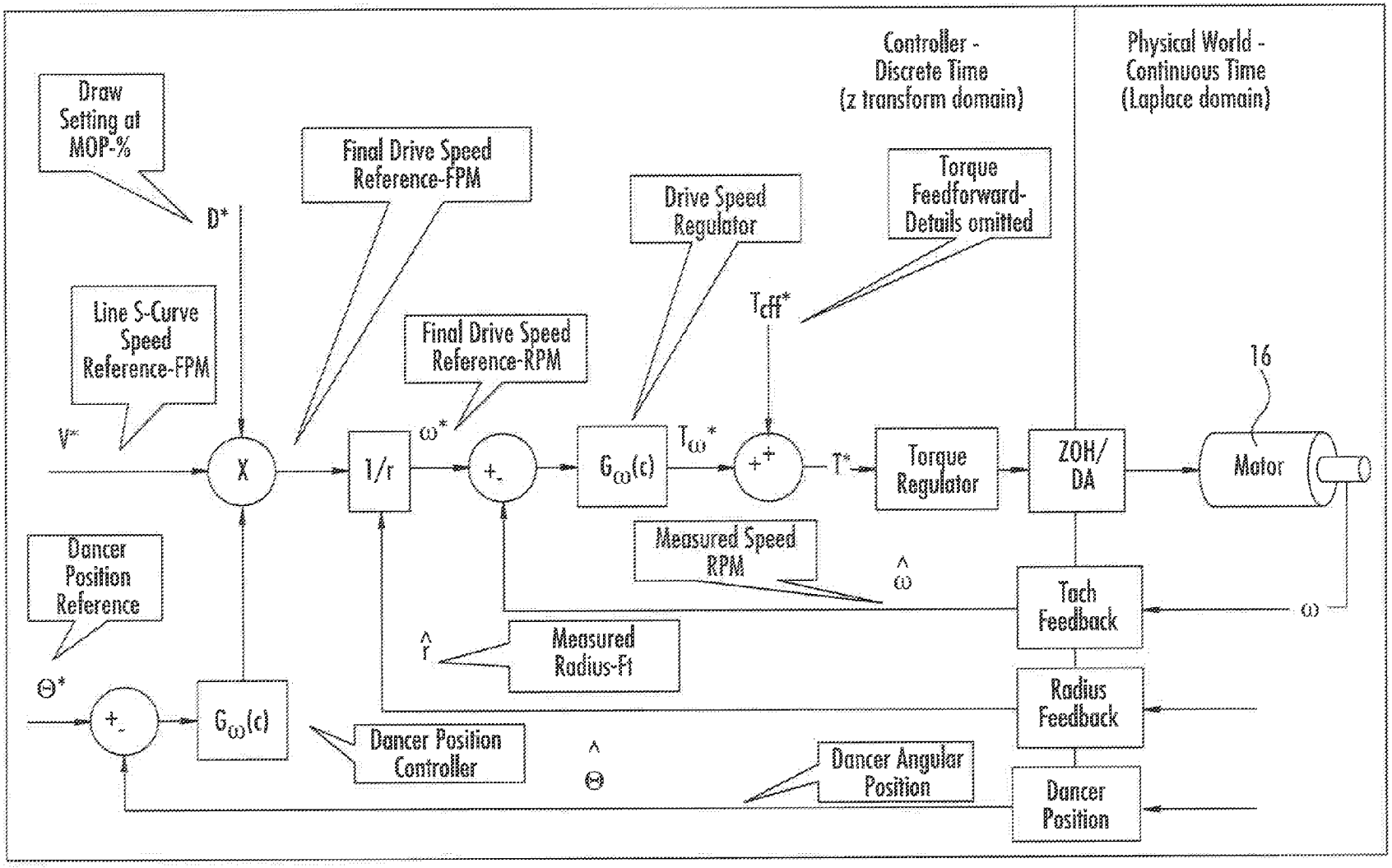
FIG. 10 is another embodiment of a control system block diagram.

The block diagram or flow chart shown in FIG. 9 is directed to controlling the amount of torque applied to the pivot dancer device 10. In order to control tension variations, the controller 40 may also be configured to control the unwind device 16 for controlling the speed at which the web 12 is unwound. FIG. 10 illustrates one embodiment of a flow chart for controlling web acceleration. In this manner, the controller 40 can be configured not only to control the speed or acceleration at which the web is unwound but also control the torque applied to the pivot dancer device in a closed loop fashion. In one embodiment, for instance, the unwind speed can be used to control a certain type of web tension disturbance while the torque applied to the pivot dancer device may be used to control other types of web tension disturbances.

In still another embodiment of the present disclosure, the pivot dancer device 10 may be used in an open loop control system. In an open loop system, the system may be more robust than the closed loop system but may make less adjustments than the closed loop system.

In one embodiment, for instance, the torque supplying device 28 can be configured to apply torque to the pivot dancer device 10 for creating constant web tension. Additional torque is applied to account for rotation of the torque supplying device to maintain constant tension in the web. The rotational position of the pivot dancer device 10 is controlled by modifying the speed of the upstream web using the unwind motor 16.

During normal operation, the pivot dancer device 10 remains stationary and the torque applied to the pivot dancer device creates tension in the web. The speed of the web being fed to the pivot dancer device is controlled to maintain the same rotational position of the pivot dancer device.

When a web disturbance causes an imbalance between the amount of web being fed upstream and downstream of the pivot dancer device, a tension difference exists between the upstream and downstream which causes the pivot dancer device to rotate to maintain constant tension. The rotational motion of the pivot dancer device also consumes some of the torque to accelerate the pivot dancer device inertia. This change in angular velocity is sensed by the sensor 42 and the torque required to accelerate the pivot dancer device is added or subtracted from the constant tension torque.

Figure 11:
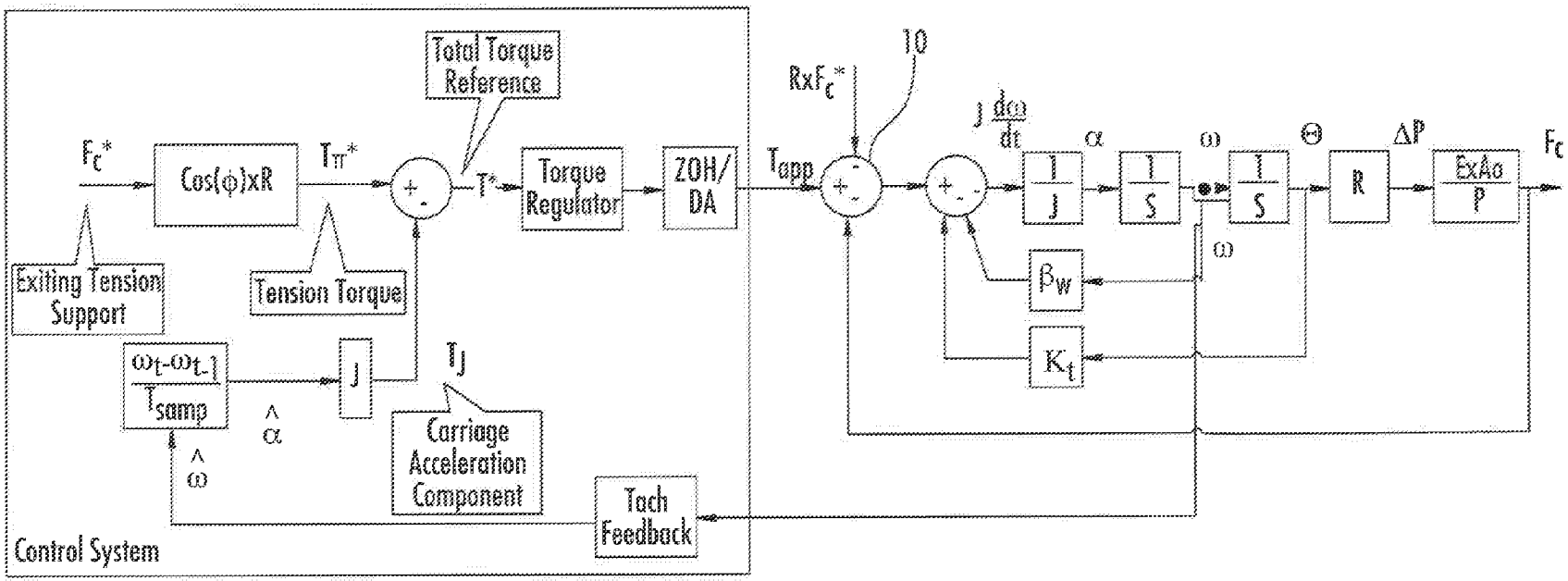
FIG. 11 is another embodiment of a control system block diagram.

Tension control in an open loop system is shown in FIG. 11. Control of the unwind motor may be the same as shown in FIG. 10.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A device for controlling tension in a sheet being fed to a process comprising:

a first guide roll spaced from a second guide roll, the first and second guide rolls being held in a coplanar relationship by a first frame, the first frame being pivotally attached to a second frame at a pivot location between the first and second guide rolls; and a torque supplying device that supplies a controllable amount of torque to the first frame at the pivot location, the torque supplying device comprising a motor.

2. A device as defined in claim 1, wherein the pivot location is midpoint between the first guide roll and the second guide roll on the first frame in the plane in which the first and second guide rolls reside.

3. A device as defined in claim 1, wherein the motor of the torque supplying device is operatively attached to the first frame at the pivot location by a belt.

4. A device as defined in claim 1, further comprising a torque controller that is configured to control the amount of torque applied to the first frame at the pivot location by the torque supplying device.

5. A device as defined in claim 1, further comprising a first load cell that measures sheet tension of a sheet being fed to the device and a second load cell that measures sheet tension of a sheet exiting the device.

6. A device as defined in claim 5, further comprising a torque controller that is configured to control the amount of torque applied to the first frame at the pivot location by the torque supplying device, wherein the torque controller is in communication with the first load cell and the second load cell.

7. A device as defined in claim 6, wherein the torque controller is configured to compare sheet tension before the device to sheet tension after the device and, based on any differences in sheet tension, controlling the amount of torque applied to the pivot location.

8. A device as defined in claim 1, wherein the torque supplying device rotates the first frame about the pivot location in an amount from about 0 degrees to about 180 degrees in adjusting the amount of torque applied to the first frame.

9. A device as defined in claim 1, further comprising a first fixed roll positioned directly upstream from the first guide roll and a second fixed roll positioned directly downstream from the second guide roll.

* * * * *